US005132198A

United States Patent [19]

Tamary

[11] Patent Number: 5,132,198

[45] Date of Patent: Jul. 21, 1992

[54] HIGH RESOLUTION TONER IMAGE FINISHING METHOD USING HEAT, PRESSURE AND ELECTRIC FIELD

[75] Inventor: Ernest J. Tamary, Brighton, N.Y.

[73] Assignee: Eastman Kodak Company, Rochester, N.Y.

[21] Appl. No.: 506,031

[22] Filed: Apr. 6, 1990

[51] Int. Cl.[5] ..... G03G 13/16

[52] U.S. Cl. ..... 430/124; 430/99; 430/110

[58] Field of Search ..... 430/109, 110, 124, 99

[56] References Cited

U.S. PATENT DOCUMENTS 3,948,215 4/1976 Namiki ..... 118/60
4,337,303 6/1982 Sahyun et al. ..... 430/11
4,419,004 12/1983 Kuehnle ..... 355/3 TR
4,780,742 1/1987 Franke ..... 355/3 FU

FOREIGN PATENT DOCUMENTS 0295901 12/1988 European Pat. Off. .
0301585 2/1989 European Pat. Off. .
63-92965 4/1988 Japan .

*Primary Examiner*—David Welsh
*Assistant Examiner*—S. Rosasco
*Attorney, Agent, or Firm*—Leonard W. Treash, Jr.

[57] ABSTRACT

A small particle toner image is carried on a heat-softenable outer layer of a receiving sheet. The toner is embedded in the layer by application of an electric field to the toner while the layer has been softened by heating. Preferably, the toner is charged prior to the field-applying step to make it responsive to the field. Pressure may be applied to assist in the embedding process.

10 Claims, 3 Drawing Sheets

HIGH RESOLUTION TONER IMAGE FINISHING METHOD USING HEAT, PRESSURE AND ELECTRIC FIELD

CROSS REFERENCE TO RELATED APPLICATION

This application is related to U.S. Pat. application Ser. No. 07/405,258, filed Sep. 11, 1989, in the name of Rimai et al and entitled TONER FIXING METHOD AND APPARATUS AND IMAGE BEARING RECEIVING SHEET.

FIELD OF THE INVENTION

This invention relates to finishing high-resolution toner images carried on a heat softenable outer layer of a receiving sheet. It is especially applicable to high quality color toner images.

BACKGROUND ART

Most prior attempts to create color images of photographic quality using the science of electrophotography have employed liquid developers. For many years it was thought that liquid developers were the only developers with fine enough particles to give the resolution ordinarily experienced with silver halide photography. Recently, multicolor images have been formed using toner particles finer than 8 microns in diameter and in some instances finer than 3.5 microns in diameter. With such size particles granularity comparable to silver halide photography is obtainable.

Finishing color images with such fine particles while maintaining resolution has posed many problems. Ordinary heated roller, pressure fusing has a tendency to spread the particles on the surface of a receiving sheet, destroying the fine granularity created by the fine particles. Infrared heating also causes some spread of the particles as the particles are encouraged to flow in order to become fixed.

Of more concern, the particles are formed on the surface of the receiving sheet in a series of layers, the height of which is dependent upon the density and the particular combination of colors needed to make up the image. This creates a substantial relief image which is quite noticeable to the eye. This is especially the case after infrared fusing, but also is apparent after hot pressure roller fusing of the type used in most copiers. This relief image is sufficiently unacceptable that a multicolor print made with it would not be competitive with a comparable silver halide product.

In most photographic work a glossy appearance is desirable and provides an appearance of image sharpness. However, with prior copying fusing systems, gloss levels in excess of 20 are rare. Further, the same variation in amount of toner which causes relief also causes a variation in image gloss across a single image.

U.S. Pat. No. 4,337,303, Sahyun et al, issued Jun. 29, 1982, discloses a relatively low speed method of transferring fine toner particles from a photoconductor to a receiving sheet having a thermoplastic coating on it. According to that patent the thermoplastic coating is heated to its softening point, preferably a temperature between 20° and 70° C. Under moderate pressure the toner is "encapsulated" in the thermoplastic layer, with less than 25% of the particles protruding.

Japanese Kokai 63-92965 (1988), laid-open Apr. 23, 1988, discloses a method of treating a color image on a thermoplastic layer on a receiving sheet by passing the sheet between a pair of rollers, with at least the roller contacting the image being heated in the presence of a pressure of 4 kg/cm$^2$. Both rollers are formed of silicone rubbers. It is suggested that, if the thermoplastic is heated higher than its softening point but lower than the softening point of the toner, the toner can be pushed into the thermoplastic. This procedure, it is suggested, will remove the unevenness of the surface of the electrophotographic image.

U.S. Pat. No. 4,780,742 shows a method and apparatus for treating a fixed color toner image carried on a transparency sheet. The sheet is passed between a thin plastic sheet and a pair of rollers in the presence of heat which presses the thin sheet around the toner to soften, fuse and add gloss to the image. The thin sheet is peeled off after the image has cooled. According to the patent, this provides an image that scatters light less in projection.

European patent application 0 301 585 published Feb. 1, 1989, shows a glazing sheet used to increase the gloss of either a toner image on a paper support or a dye and developer in a thermoplastic coating. The glazing sheet is pressed against the paper sheets with moderate pressure and the dye-thermoplastic sheets with substantial pressure. Resolution, relief and variable glossing are not mentioned as problems.

In the latter two references the image and sheet are allowed to cool before separation. This approach to preventing release in pressure fixing devices is shown in a large number of references; see, for example, European patent application 0 295 901 and U.S. Pat. No. 3,948,215.

In general, the use of a softenable outer layer into which the toner is imbedded permits finer resolution and reduces toner image relief. However, high pressure in embedding such toner can cause irregularities in the thermoplastic surface which also detract from the appearance of the image.

U.S. Pat. No. 4,419,004 issued Dec. 6, 1983 to Kuehnle shows an electrophoretic transfer and fixing method in which a toner image carried in a liquid is transferred under the urging of an electric field and embedded in a heat-softened overcoat on a receiving paper. An electrophoretic migration apparently begins in the liquid developer and continues in the molten overcoat.

DISCLOSURE OF THE INVENTION

It is the object of the invention to provide a method of fixing a dry toner image carried on a heat-softenable outer layer of a receiving sheet with less risk of damaging the uniformity of the outer surface of the end product.

This and other objects are accomplished by heating said heat-softenable layer until soft and applying an electric field having a direction urging the toner into the softenable layer.

According to a preferred embodiment the toner image is charged prior to application of the electric field by spraying corona onto it. The charged image is then urged by the electric field, for example, a field of 800–1000 volts, into the softened layer.

According to another preferred embodiment pressure is also applied to the image, for example, using a ferrotyping material during said field applying step. The combination of pressure and the electric field embeds the toner in the softened layer.

Whether pressure is also applied or not, the use of the electric field reduces the need for high pressure thereby improving the process in terms of both the resolution of the fixed image and the uniformity of the surface containing the image.

DESCRIPTION OF THE PREFERRED EMBODIMENTS

Figures 1A, 1B, 1C:
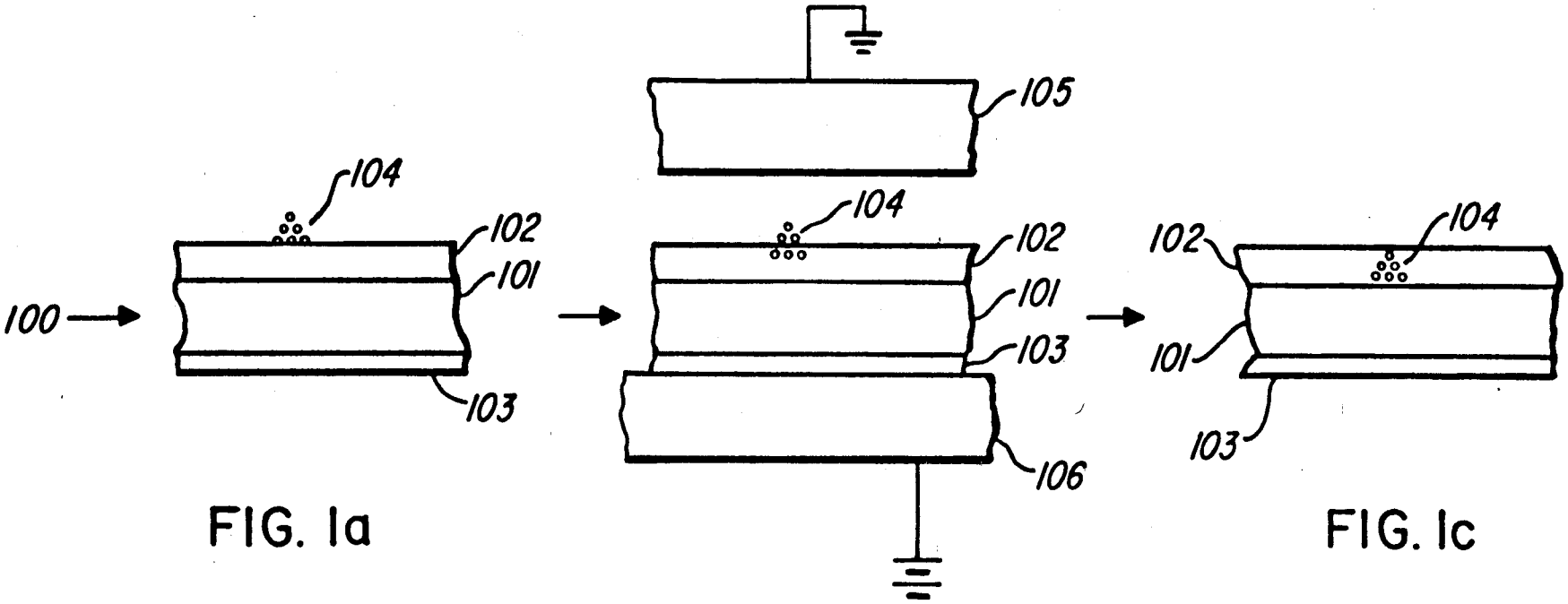
FIGS. 1(*a,b,c*) is a schematic illustrating fixing a toner image to a receiving sheet according to the invention.

According to FIG. 1, a receiving sheet 100 for very high quality imaging includes a paper substrate 101 having an outer layer 102 which is heat-softenable. For example, the layer 102 can consist of a heat-softenable thermoplastic having a glass transistion temperature between 45 and 70 degrees C. By way of example only, a 0.5 mil coating of a polystyrene thermoplastic having a glass transistion temperature between 55 and 65 degrees C. can be used. To prevent curl of the receiving sheet as it is processed and thereafter, a thermoplastic layer 103 can be coated on the side of substrate 101 opposite layer 102. Preferably, layer 103 is of a relatively high melting point thermoplastic, for example, a 1.0 mil coating of polyethylene or polypropylene.

A toner image 104 has been transferred to or otherwise formed on the surface of heat-softenable layer 102. Although the invention can be used for larger toner particles, it is very useful with particles having a mean size less than 8 μm, and especially very small particles 3.5 μm (mean size) and less. Preferably, such toners have a glass transistion temperature only slightly above that of the layer 102, although higher melting point toners also work in the process. If heat has been used in the transfer process, a portion of the toner layer 104 may be embedded in layer 102 from that process.

If the image is fixed using conventional roller fusing, the toner becomes soft and, under pressure, spreads. This causes a loss of resolution of the image that is unacceptable in highest quality color work. It also has irregular gloss and contour as the amount of toner varies across the surface.

At step (b), heat is applied using convection heating element 106 and radiant heating element 105 to heat layer 102 to at least its softening point. At the same time an electric field, for example, a field of 800–1000 volts, is applied between members 105 and 106 of a direction which urges the toner particles 104 into layer 102 to totally embed particles 104 in layer 102 as shown at (c) without the application of pressure. Preferably, toner 104 has a softening point above that of layer 102 and therefore readily penetrates layer 102 and does not spread in the process.

Figure 2:
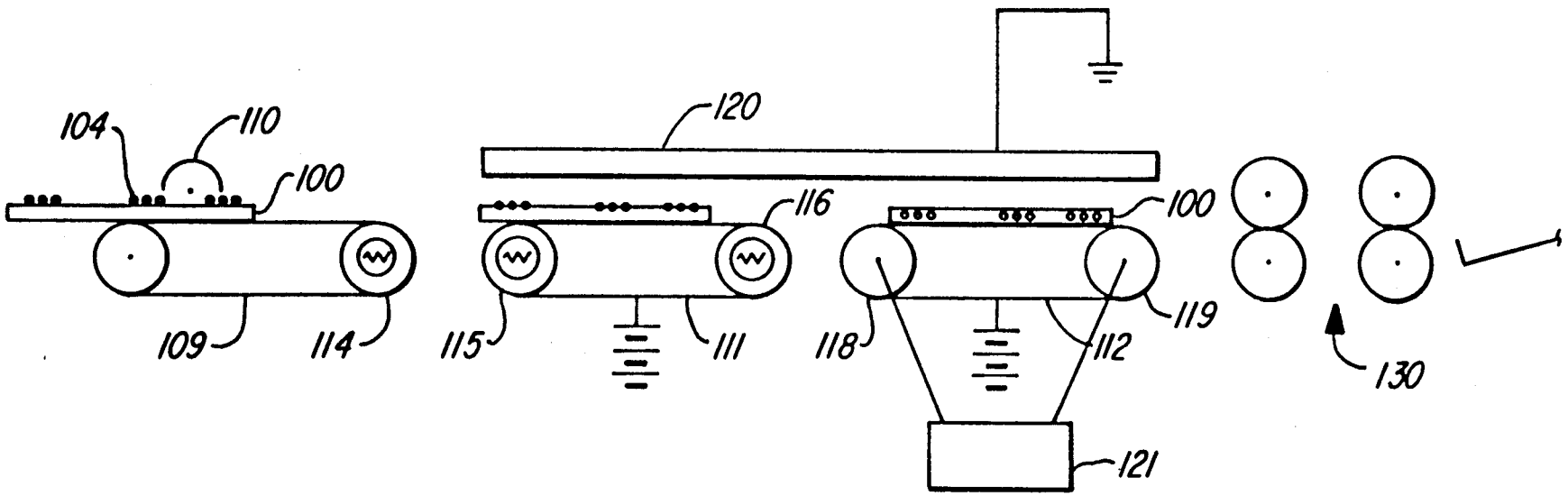
FIGS. 2 and 3 are schematic side views of apparatus for carrying out the method illustrated in FIG. 1 according to alternative preferred embodiments of the invention.
Figure 3:
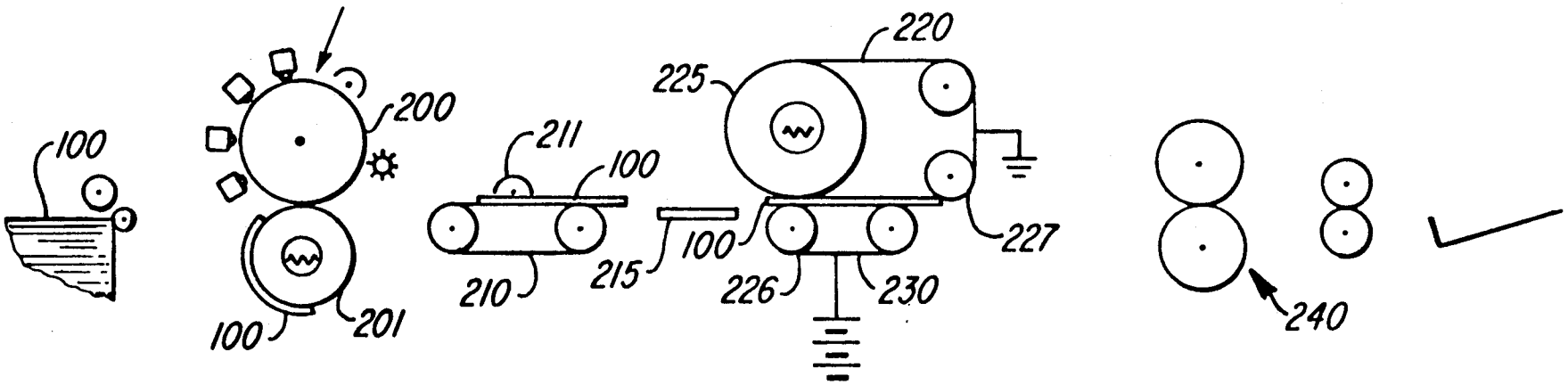

Alternative preferred embodiments of the invention are illustrated by apparatus for carrying it out shown in FIGS. 2 and 3. According to FIG. 2, receiving sheet 100 carrying toner image 104 is transported by a first transport belt 109 under a corona charger 110. Charger 110 sprays a negative corona charge on the outer surface of receiving sheet 100 thereby imparting a negative charge to the toner image 104. Receiving sheet 100 is transferred to a second sheet transport mechanism where it is carried on a metallic belt 111 supported by a pair of heated rollers 115 and 116. Heated rollers 115 and 116 heat metal belt 111 to heat receiving sheet 100 to soften layer 102. Belt 111 carries receiving sheet 100 in close proximity to a grounded plate 120. A strong positive voltage, for example, 800–1000 volts, is applied to metal belt 111 to create an electric field between belt 111 and grounded plate 120 urging the negatively charged toner 104 into layer 102 as in FIG. 1. To assist in the process of softening layer 102, receiving sheet 100 can be heated prior to entering the electric field, for example, by heated roller 114 which is part of the first sheet transport 109.

Sheet 100 is then transferred to a third sheet transport including a belt 112 around rollers 118 and 119. Rollers 118 and 119 are connected to a cooling means 121 to cool layer 102 below its softening point to fix the image therein. Preferably, the cooling step is accomplished while the field is maintained. Thus, a strong positive voltage continues to be applied to the third transport.

The receiving sheet 100 with the image fixed in its outer layer 102 can then be further finished by conveying it through pairs of finishing rollers 130 which can impart textures to it or add gloss to it as is well known in the art.

Note that in both FIGS. 1 and 2, the image is not contacted during the fixing process. Thus, release materials commonly used in pressure roller fusing are not necessary. This is an important advantage of this embodiment of the process because variance in the release liquids on the surface of the glossy images detracts from their quality.

Another embodiment of the invention is shown in FIG. 3. Receiving sheet 100 is fed from a supply of similar receiving sheets into a nip formed between a photoconductive drum 200 and a transfer drum 201. Toner image 104 has been formed by conventional electrophotographic means on photoconductive drum 200. Receiving sheet 100 is secured to transfer drum 201 and rotated 3 or 4 times through the nip to receive a series of different color images in registration. Receiving sheet 100 is separated from transfer drum 201 after receipt of the last image and conveyed by a sheet transport 210 under charger 211 which sprays a negative electrostatic charge on the multicolor toner image 104 as in FIG. 2.

As sheet 100 leaves transport 210 it passes across preheating plate 215 which heats layer 102 toward its softening point. Receiving sheet 100 then passes into a nip between a ferrotyping web 220 which has a smooth hard surface which applies pressure to the toner image helping embed it in layer 102. The other portion of the nip is formed by an endless transport web 230. An electric field is created between ferrotyping web 220 and web 230 urging the negatively charged toner image into softened layer 102. The beginning of the nip between the webs is defined by support rollers 225 and 226. To maintain a softened condition for layer 102 in the nip at least one of rollers 225 or 226 should be heated, preferably roller 225. The ferrotyping material in web 220 helps supply pressure to the toner to embed it in the layer 102 without spreading it. However, this action is assisted by the field applied between the 2 webs thereby reducing the necessity of high pressures and thereby reducing the risk of creating non-uniformities in the surface of the receiving sheet and toner image.

The receiving sheet is allowed to cool as it maintains contact with ferrotyping web 220 until released as the ferrotyping web moves around a small roller 227.

Receiving sheet 102 with toner image 104 embedded in layer 102 can now pass on to additional finishing stations. For example, it can go to a station 240 where a set of rollers (or an additional ferrotyping web) contacts the image under conditions of heat and pressure that add a gloss or a texture to it, as is well known in the art. Although the pressure and electrical field are preferably applied simultaneously, they can be applied in separate stations.

Reference is made to U.S. patent application Ser. No. 405,258, Rimai et al, which application is incorporated by reference herein, describing materials and apparatus for embedding toner in a heat-softenable layer using heat and high pressure. Although similar apparatus and the same materials can be used herein, the application of the electrical field according to the invention permits lower pressures to be used to achieve comparable results to those of that application. The lower pressure (FIG. 3) or no pressure (FIG. 2) reduces irregularities in the surface caused by high pressure and reduces or eliminates the tendency of the toner to spread while it is being embedded. Further, if the toner is pressed into the heat-softenable layer it has a tendency to resurface or float back to the top as the layer cools as a function of the buoyancy, viscosity and relaxation time of the layer. The field helps keep the toner submerged until cooling fixes the encapsulation.

Although a field strength of 800–1000 volts works well for the materials disclosed in the Rimai application, the preferred field strength would vary according to the size of the toner particles, their charge, the densities of the toner and the heat softenable layer at the operating temperature and the viscosity and relaxation time of the layer.

The invention has been described in detail with particular reference to a preferred embodiment thereof, but it will be understood that variations and modifications can be effected within the spirit and scope of the invention as described hereinabove and as defined in the appended claims.

I claim:

1. A method of fixing a dry toner image carried by a heat softenable outer layer on a receiving sheet, said method comprising heating said heat softenable layer until soft and applying an electric field having a direction urging said toner into said softenable layer.

2. The method according to claim 1 wherein said heating step is carried out prior to said electric field applying step.

3. The method according to claim 1 including the additional step of charging said toner image prior to the step of applying said electric field.

4. The method according to claim 3 wherein said charging step includes spraying a corona charge onto said image prior to said electric field applying step.

5. The method according to claim 1 including the additional step of applying pressure to said image during said field applying step to urge said toner to embed into said softened layer by the combination of said field and said pressure.

6. The method according to claim 1 wherein said toner has a median particle size less than 8 μm.

7. The method according to claim 6 wherein said toner image is made up of toners of varying color which have a median particle size less than 3.5 μm.

8. An image forming method comprising the steps of:

forming a series of electrostatic images on an image member, applying dry toner particles of a different color toner to each of said electrostatic images to create a series of different color toner images, transferring said series of different color toner images in registration to a surface of a heat softenable layer on a receiving sheet, heating said heat softenable thermoplastic layer above its glass transition temperature to soften said layer, and while said layer is heat softened, subjecting said image to pressure from a smooth, hard surface urging said toner particles into said heat softened layer in the presence of an electrical field also urging said toner particles into said heat softened layer to embed said toner particles in said layer.

9. The method according to claim 8 wherein said step of subjecting said image to pressure is accomplished by feeding said receiving sheet between a pair of pressure applying members.

10. The method according to claim 9 wherein one of said pressure applying members is a ferrotyping belt which contacts said image to urge the image into said heat softened layer in the presence of said electric field.

* * * * *